US006555752B2

(12) United States Patent
Dalrymple et al.

(10) Patent No.: US 6,555,752 B2
(45) Date of Patent: Apr. 29, 2003

(54) CORROSION-RESISTANT SUBMERSIBLE PUMP ELECTRIC CABLE

(75) Inventors: Larry Verl Dalrymple, Claremore, OK (US); Ernesto Alejandro Vilcinskas, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/036,996

(22) Filed: Dec. 21, 2001

(65) Prior Publication Data

US 2002/0092667 A1 Jul. 18, 2002

Related U.S. Application Data

(63) Continuation-in-part of application No. 09/544,350, filed on Apr. 6, 2000, now abandoned.

(51) Int. Cl.[7] ..... H01B 7/20
(52) U.S. Cl. ..... 174/102 R; 174/105 R
(58) Field of Search ..... 174/102 R, 105 R, 174/106 R, 113 R

(56) References Cited

U.S. PATENT DOCUMENTS

| | | | | |
|---|---|---|---|---|
| RE20,766 | E | 6/1938 | Benit | |
| 3,197,553 | A | 7/1965 | Nicolas | |
| 3,710,007 | A | 1/1973 | Hoeg et al. | |
| 3,809,802 | A | 5/1974 | Pearson | |
| 4,088,830 | A | 5/1978 | Wargin et al. | |
| 4,262,703 | A | 4/1981 | Moore et al. | |
| 4,374,530 | A | 2/1983 | Walling | |
| 4,399,319 | A | 8/1983 | Zinn | |
| 4,472,598 | A | 9/1984 | Boyd et al. | |
| 4,572,926 | A | 2/1986 | Gaussle et al. | |
| 4,701,575 | A | 10/1987 | Gupta et al. | |
| 4,701,576 | A | 10/1987 | Wada et al. | |
| 4,780,574 | A | 10/1988 | Neuroth | |
| 5,384,430 | A | 1/1995 | Anthony et al. | |
| 5,426,264 | A | 6/1995 | Livingston et al. | |
| 5,431,759 | A | 7/1995 | Neuroth | |
| 5,528,824 | A | 6/1996 | Anthony et al. | |
| 5,742,008 | A | 4/1998 | Dalrymple | |
| 5,782,301 | A | 7/1998 | Neuroth et al. | |
| 5,821,452 | A | 10/1998 | Neuroth et al. | |
| 6,207,902 | B1 * | 3/2001 | Balaguer | 174/112 |

* cited by examiner

*Primary Examiner*—Chau N. Nguyen
(74) *Attorney, Agent, or Firm*—Bracewell & Patterson, L.L.P.

(57) ABSTRACT

An improved cable and cable sheathing arrangement that affords protection for the conductive elements against corrosion, chemical and physical hazards. In exemplary embodiments described herein, the cable includes a plurality of copper conductors that are individually encased in a thermoplastic insulation. An extruded lead sheath surrounds the thermoplastic insulation. Finally, a thermoplastic jacket encloses the lead sheaths of the conductors in surrounding contact to provide a unitary cable. A cost effective cable is provided, and the need for an external metal armor is reduced or eliminated. Additionally, the cable provides substantial and adequate resistance to corrosion and physical hazards.

14 Claims, 2 Drawing Sheets

CORROSION-RESISTANT SUBMERSIBLE PUMP ELECTRIC CABLE

CROSS-REFERENCE TO RELATED APPLICATIONS

This is a continuation-in-part of U.S. patent application Ser. No. 09/544,350 filed Apr. 6, 2000 now abandoned.

BACKGROUND OF THE INVENTION

1. Field of the Invention

The present invention relates to electrical cables of the type used in undersea applications such as for electric submersible pumps and the like.

2. Description of the Related Art

Electrical cables are used to interconnect electric motors to submersible pumps or other equipment in oil and gas wells. These cables ordinarily consist of three solid or stranded electrical conductors that are combined into a single cable.

Electrical cables for submersible pumps and the like contain copper conductive cables that must be protected from the extremely corrosive effects of the well fluids that surround the cable. Typical current designs for submersible pump cables use outer metal armor that is wrapped around a rubber jacket. The jacket surrounds a number of insulated conductors. The armor protects the conductors against impacts and abrasion. Lead sheaths around the insulated conductors are employed with some cables to provide protection against hydrogen sulfide and other corrosive chemicals. This arrangement is sturdy and provides significant protection against external physical hazards. In some of these arrangements, the lead sheaths are applied to the insulated conductors by wrapping lead strips helically around the insulated conductors. In others, the lead sheaths are extruded around the insulated conductors.

A problem inherent to armored cables is that the outer steel armor corrodes over time. Corrosion may occur when stored on the surface or it may occur in a well due to chemical attack. Such corrosion costs the industry millions of dollars annually. The armor can corrode to the point that its integrity is lost. When this occurs, gases trapped within the cable while in a well may decompress while pulling the cable from the well. This may rupture the cable causing the cable to fail electrically. In addition, corroded away portions of the external armor will tend to foul or contaminate the wellbore.

A related consideration for submersible pump cables is the cost and difficulty of manufacture of the cable. Some cable designs that provide sufficient protection against both corrosion and physical hazards are known, however, they are costly and difficult to manufacture. U.S. Pat. No. 3,809,802 issued to Pearson, for example, describes a round submersible pump cable in which the three conductors in the cable are twisted into a bundle in a braid-like fashion. Lead shielding is provided around each of the conductors. In order to manufacture this type of cable, the lead shields must be first encased with an extruded plasticized nylon or other abrasion resistant plastic. The plastic used must have particular properties of pliability, abrasion resistance, and the ability to withstand high temperatures. In addition, the plastic must be compatible with the rubber jacket that surrounds it and, as a result, the number of materials that are suitable is somewhat limited. Further, extruding the abrasion resistant material over the lead shields adds an extra manufacturing operation that must be performed in making the cable and can be costly.

SUMMARY OF THE INVENTION

The present invention provides an improved cable and cable sheathing arrangement that affords protection for the conductive elements against corrosion, chemical and physical hazards.

In a first exemplary embodiment, a round cable is described that includes a plurality of copper conductors that are encased in a thermoplastic insulation. In an alternative exemplary embodiment described herein, a flat cable is described that includes a plurality of copper conductors that are individually encased in a thermoplastic insulation and disposed in a side-by-side relation to one another. In both cases, an extruded lead sheath surrounds the thermoplastic insulation. In the case of the rounds cable, the three lead sheathed conductors are cabled together. Finally, a thermoset or thermoplastic jacket encloses the lead sheaths of the conductors to provide a unitary cable. The jacket is in surrounding contact with each of the lead sheaths so that at least a majority of the outer circumference of the sheaths are contacted by the jacket. It is preferred that at least ¾ of the outer circumference is in such surrounding contact with the jacket, and in the most preferred embodiment, the entire circumference of the sheaths are surrounded by and substantially contacted by the jacket. A cost effective cable is provided, and the need for an external metal armor is reduced or eliminated. Additionally, the cable provides substantial and adequate resistance to corrosion and physical hazards.

DETAILED DESCRIPTION OF THE PREFERRED EMBODIMENTS

Figure 1:
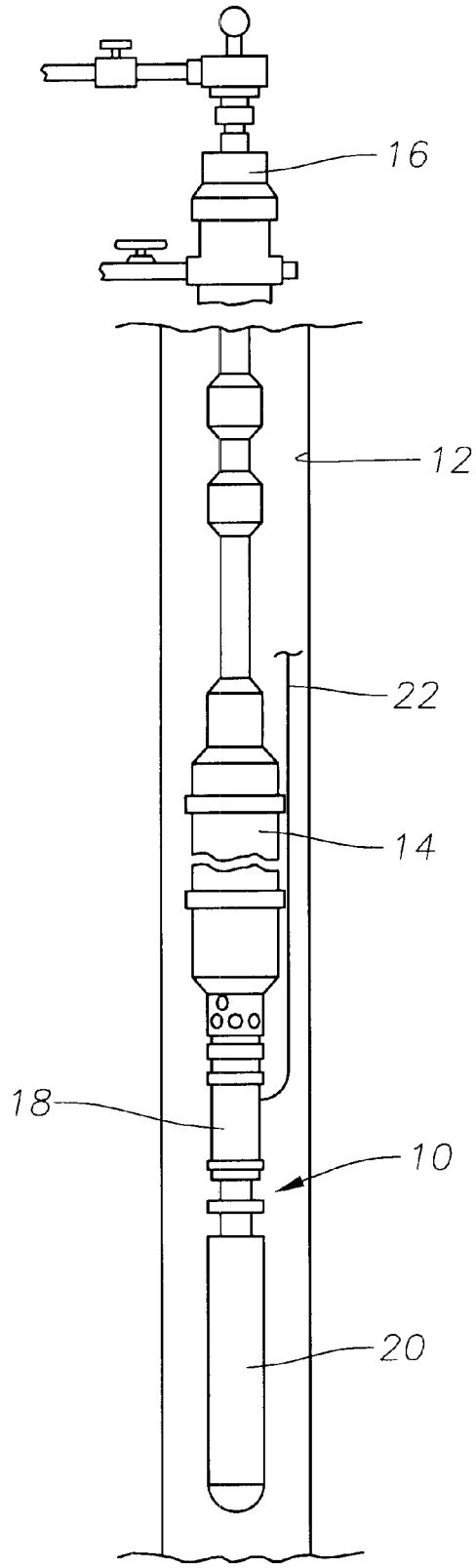
FIG. 1 is a schematic view of an exemplary well having a submersible pump.

FIG. 1 illustrates an exemplary electrical submersible pump 10 located in a well 12. The pump 10 includes a centrifugal fluid pump 14 that has an intake 15 for conducting well fluids to a well head 16 located at the surface. The submersible pump 10 normally pumps a mixture of oil and brine from wells that have been drilled several thousand meters deep and under high temperatures and pressures. The pump 10 also has a seal section 18 connected below the centrifugal pump component 14. An electrical motor 20 is connected to the seal section 18. The seal section 18 prevents well fluid from seeping into the motor 20 and equalizes internal lubricant pressure in the motor with the hydrostatic pressure in the wellbore. An electrical cable 22 provides electrical power to the motor 20 from a power source (not shown) that is located at the surface of the sea. As the operations associated with submersible pumps, motors and wells are well understood in the art, they will not be described in further detail here.

Figure 2:
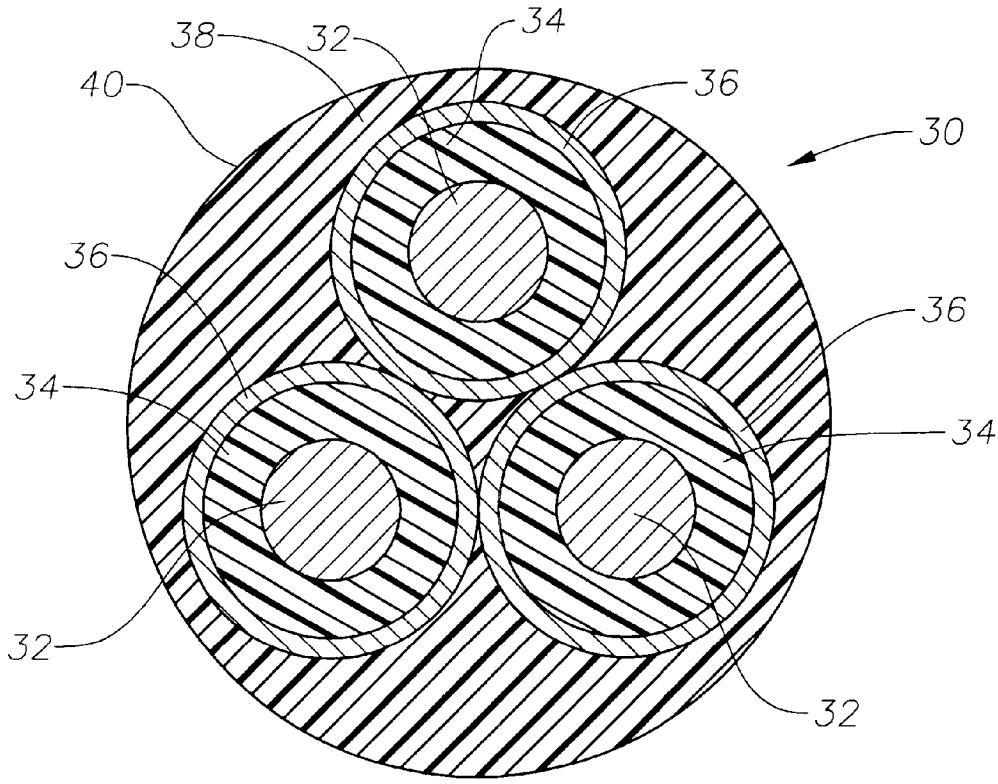
FIG. 2 is a cross-sectional view of an exemplary round cable constructed in accordance with the present invention.

Referring now to FIG. 2, there is shown in cross-section an exemplary cable 30 that may be used as the power cable 22 shown in FIG. 1. The cable 30 includes three conductors 32 that are preferably formed of copper. Although the conductors 32 are shown as being solid conductive elements, it will be understood that they may also be formed of stranded copper cable members.

Surrounding each of the conductors 32 is a thermoplastic coating 34 that is formed of a resilient and flexible material such as polypropylene which is a proven insulation for downhole use up to around 225'F. Although polypropylene is preferred for use as the thermoplastic coating, other durable materials, such as EPDM (ethylene-propylene-diene monomer) may be used as well. The thermoplastic coating 34 preferably has a thickness of around 75–90 mils.

A lead sheath 36 surrounds the thermoplastic coating 34 for each of the conductors 32. The sheath 36 is preferably extruded onto the thermoplastic coating to provide a gas and liquid tight barrier. The lead sheath 36 provides protection against corrosive chemicals such as hydrogen sulfide. The lead sheath 36 is substantially impervious to fluids and, thus, serves as a barrier that resists the migration of gases into the thermoplastic coating 34. A currently preferred thickness for the lead sheath 36 is approximately 40 mils.

The lead sheaths 36 of all three conductive elements 32 are encased within a second thermoplastic jacket or covering 38 that forms the outer surface 40 of the cable 30. The jacket 38 is preferably formed of polypropylene, but may also be formed of nitrile, EPDM or another thermoplastic material that provides suitable protection against chemical and physical corrosion and wear. The jacket 38 contacts and engages each of the lead sheaths 36 in a substantially surrounding contact. It is noted that the jacket 38 surrounds and contact a majority of each lead sheath 36. It is preferred that the jacket 38 be in surrounding contact with at least ¾ of the exterior circumference of the lead sheaths 36. In a more preferred embodiment, the entire exterior circumference of the lead sheaths 36 are surrounded by the jacket 38 and in substantially complete contact with the jacket 38.

Prior to depositing or coating the lead sheaths 36 with jacket 38, the three conductive elements 32, along with their thermoplastic coatings 34 and lead sheaths 36, are preferably cabled together. This is accomplished by intertwining the conductive elements 32 upon one another in the manner of ropes, braids and the like.

Figure 3:
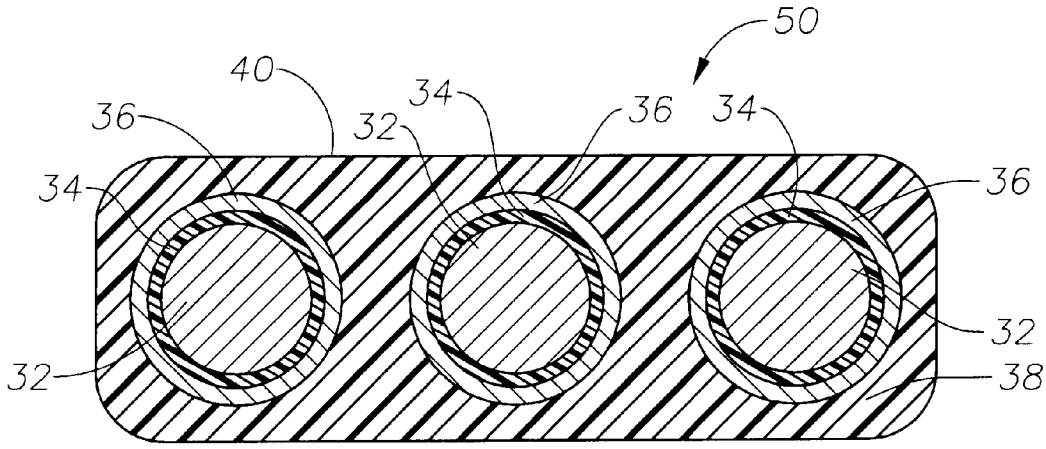
FIG. 3 is a cross-sectional view of an exemplary cable constructed in accordance with the present invention having a flattened cross-section.

FIG. 3 depicts, in cross-section, an alternative exemplary cable 50 that may also be used as the power cable 22 shown in FIG. 1. Like components between the two embodiments are numbered alike. It is noted that the three conductive elements 32 in cable 50 are arranged in a substantially linear and parallel relation so that the cable 50 has a flattened profile.

In operation, the cables 30 or 50 can be submerged in oil and water during operation of the submersible pump 22. The outer thermoplastic covering 33 resists corrosion and physical hazards to the conductive elements within. Ballooning of the cables 30 or 50 upon removal of the cable from the well is substantially precluded by the presence of the lead sheathing 36 that surrounds each of the conductive elements. Further, the presence of the first thermoplastic layer 34 around each of the conductive elements 32 provides electrical insulation.

The invention has many advantages. The outer surface of the cables 30, 50 will be formed of thermoplastic material which does not corrode when exposed to oilwell fluids. In addition, surface storage life for the cable can be several years rather than only a few months, as in the case of armored cables.

It will be apparent to those skilled in the art that modifications, changes and substitutions may be made to the invention shown in the foregoing disclosure. Accordingly, it is appropriate that the appended claims be construed broadly and in the manner consisting with the spirit and scope of the invention herein.

What is claimed is:

1. An electrical well cable comprising:

a plurality of electrical conductors;

a thermoplastic layer surrounding each of the conductors;

an extruded lead shield surrounding each thermoplastic layer and having an outer circumference;

a single thermoplastic jacket surrounding and in surrounding contact with at least a majority of the outer circumference of each of the lead shields; and the thermoplastic jacket having an exterior that defines an exterior surface of the cable and wherein the jacket is in surrounding contact with at least three-quarters of the outer circumference of each of the lead shields.

2. The electrical well cable of claim 1 wherein the jacket is in surrounding contact with substantially the entire outer circumference of each of the lead shields.

3. The cable of claim 1 wherein the conductors are cabled together to provide a substantially round profile for the cable.

4. The cable of claim 1 wherein the conductors are substantially aligned to provide a substantially flat profile for the cable.

5. The cable of claim 1 wherein each of the thermoplastic layers is substantially comprised of polypropylene.

6. The cable of claim 1 wherein each of the thermoplastic layers is substantially comprised of EPDM.

7. The cable of claim 1 wherein each thermoplastic layer has a thickness of approximately 75 mils.

8. The cable of claim 1 wherein each lead shield has a thickness of approximately 40 mils.

9. A cable for interconnecting a submersible well pump to a power source; the cable comprising:

three electrical conductors;

a separate polypropylene insulation layer surrounding each of the conductors;

a separate lead sheath extrusion surrounding each of the insulation layers and presenting an outer circumference; and a thermoplastic jacket extrusion having an exterior that defines the exterior of the cable, and wherein the thermoplastic jacket extrusion is in surrounding contact with at least three-quarters of the outer circumference of each sheath.

10. The cable of claim 9 wherein the conductors are cabled together to provide a substantially round profile for the cable.

11. The cable of claim 9 wherein the conductors are substantially aligned to provide a substantially flat profile for the cable.

12. A cable for interconnecting a submersible well pump to a power source; the cable comprising:

three electrical conductors;

a separate polypropylene insulation layer surrounding each of the conductors;

a separate lead sheath extrusion surrounding each of the insulation layers and presenting an outer circumference; and a thermoplastic jacket extrusion over all of the sheaths and in surrounding contact with the entire outer circumference of each sheath, the jacket having an exterior that defines the exterior of the cable.

13. The cable of claim 12 wherein the conductors are cabled together to provide a substantially round profile for the cable.

14. The cable of 12 wherein the conductors are substantially aligned to provide a substantially flat profile for the cable.

* * * * *

UNITED STATES PATENT AND TRADEMARK OFFICE

CERTIFICATE OF CORRECTION

PATENT NO. : 6,555,752 B2
DATED : April 29, 2003
INVENTOR(S) : Larry Verl Dalrymple et al.

It is certified that error appears in the above-identified patent and that said Letters Patent is hereby corrected as shown below:

Column 2,
Line 15, delete “rounds” and insert therefor -- round --
Line 24, delete “are” and insert therefor -- is --

Column 3,
Line 26, delete “contact” and insert therefor -- contacts --
Line 31, delete “are” and insert therefor -- is --

Signed and Sealed this

Twenty-second Day of July, 2003

JAMES E. ROGAN
*Director of the United States Patent and Trademark Office*